US007694732B2

(12) United States Patent
Rogers et al.

(10) Patent No.: US 7,694,732 B2
(45) Date of Patent: Apr. 13, 2010

(54) DIVERTER TOOL

(75) Inventors: Henry E. Rogers, Duncan, OK (US); Nicholas C. Braun, Duncan, OK (US); Steven L. Holden, Fletcher, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 1115 days.

(21) Appl. No.: 11/004,440

(22) Filed: Dec. 3, 2004

(65) Prior Publication Data

US 2006/0118295 A1 Jun. 8, 2006

(51) Int. Cl.
*E21B 33/13* (2006.01)

(52) U.S. Cl. ..... 166/177.4; 166/334.4

(58) Field of Classification Search ..... 166/177.4, 166/181, 334.4, 334.1, 373, 386
See application file for complete search history.

(56) References Cited

U.S. PATENT DOCUMENTS

| | | | | |
|---|---|---|---|---|
| 2,128,352 | A | 8/1938 | Creighton | 255/28 |
| 2,602,510 | A | 7/1952 | Baker | 166/1 |
| 2,791,279 | A | 5/1957 | Clark, Jr. | 166/225 |
| 2,846,015 | A | 8/1958 | Pittman | 166/320 |
| 2,847,074 | A | 8/1958 | Maly et al. | 166/325 |
| 2,928,470 | A | 3/1960 | Baker | 166/154 |
| 2,947,363 | A | 8/1960 | Sackett et al. | 166/318 |
| 2,998,075 | A | 8/1961 | Clark, Jr. | 166/318 |
| 3,385,370 | A | 5/1968 | Knox et al. | 166/317 |
| 3,554,281 | A | 1/1971 | Ceuer | 166/155 |
| 3,559,734 | A | 2/1971 | Pitts | 166/224 |
| 5,641,021 | A | 6/1997 | Murray et al. | |
| 5,960,881 | A | 10/1999 | Allamon et al. | |
| 6,082,459 | A | 7/2000 | Rogers et al. | |
| 6,182,766 | B1 | 2/2001 | Rogers et al. | |
| 6,318,472 | B1 | 11/2001 | Rogers et al. | |
| 6,390,200 | B1 | 5/2002 | Allamon et al. | |
| 7,322,432 | B2 * | 1/2008 | Rogers et al. | 175/232 |
| 2003/0136563 | A1 | 7/2003 | Allamon et al. | |
| 2003/0221837 | A1 | 12/2003 | Giroux et al. | |
| 2004/0000406 | A1 | 1/2004 | Allamon et al. | |
| 2004/0112606 | A1 | 6/2004 | Lewis et al. | |
| 2004/0134664 | A1 | 7/2004 | Gudmestad et al. | |

OTHER PUBLICATIONS

Foreign communication from related counter part application dated Jan. 24, 2006.

* cited by examiner

*Primary Examiner*—David J Bagnell
*Assistant Examiner*—David Andrews
(74) *Attorney, Agent, or Firm*—John W. Wustenberg; McAfee & Taft

(57) ABSTRACT

The present invention relates to a diverter tool used in a pipe string to lower a liner into a partially cased wellbore. The diverter tool has a diverter body that defines a longitudinal central flow passage and has diverter ports defined therethrough to communicate and redirect fluids received in the liner to an annulus between the diverter tool in casing previously set in the wellbore. The diverter tool has first and second closure members. The first closure member is movable between open and closed positions on the diverter body. The second closure member is detachably connected in the diverter body in its open position and is movable to its closed position to prevent flow through the diverter ports.

19 Claims, 6 Drawing Sheets

DIVERTER TOOL

BACKGROUND

The present invention relates generally to a diverter apparatus and methods and more particularly to a drill string diverter tool which will redirect fluids that have entered a casing string while the casing string is run into a wellbore.

In the construction of oil and gas wells, a wellbore is drilled into one or more subterranean formations or zones containing oil and/or gas to be produced. The wellbore is typically drilled utilizing a drilling rig which has a rotary table on its floor to rotate a pipe string during drilling and other operations. During a wellbore drilling operation, drilling fluid (also called drilling mud) is circulated through a wellbore by pumping it down through the drill string, through a drill bit connected thereto and upwardly back to the surface through the annulus between the wellbore wall and the drill string. The circulation of the drilling fluid functions to lubricate the drill bit, remove cuttings from the wellbore as they are produced and exert hydrostatic pressure on the pressurized fluid containing formations penetrated by the wellbore to prevent blowouts.

In most instances, after the wellbore is drilled, the drill string is removed and a casing string is run into the wellbore while maintaining sufficient drilling fluid in the wellbore to prevent blowouts. The term "casing string" is used herein to mean any string of pipe which is lowered into and cemented in a wellbore including but not limited to surface casing, liners and the like. As is known in the art, the term "liner" simply refers to a casing string having a smaller outer diameter than the inner diameter of a casing that has already been cemented into a portion of a wellbore.

During casing running operations, the casing string must be kept filled with fluid to prevent excessive fluid pressure differentials across the casing string and to prevent blowouts. In some cases, fluid is added to the casing string at the surface after each additional casing joint is threadedly connected to the string and the casing string is lowered into the wellbore. Well casing fill apparatus have also been utilized at or near the bottom end of the casing string to allow well fluid in the wellbore to enter the interior of the casing string while it is being run.

One purpose for allowing wellbore fluid to enter the casing string at the end thereof is to reduce the surge pressure on the formation created when the casing string is run into the wellbore. Surge pressure refers to the pressure applied to the formation when the casing being run into the wellbore forces wellbore fluid downward in the wellbore and outward into the subterranean formation. One particularly useful casing fill apparatus is disclosed in U.S. Pat. No. 5,641,021 to Murray et al., assigned to the assignee of the present invention, which is incorporated herein by reference in its entirety. Although such casing fill apparatus work well to reduce surge pressure, there are situations where surge pressure is still a problem.

Liners having an outer diameter slightly smaller than the inner diameter of casing that has previously been cemented in the wellbore are typically lowered into a partially cased wellbore and cemented in the uncased portion of a wellbore. The liner is lowered into the wellbore so that it extends below the bottom end of the casing into the uncased portion of the wellbore. Once a desired length of liner has been made up, it is typically lowered into the wellbore utilizing a drill string that is connected to the liner with a liner running tool. The liner may include a well casing fill apparatus so that as the liner is lowered into the wellbore, wellbore fluids are allowed to enter the liner at or near the bottom end thereof.

Because the drill string has a much smaller inner diameter than the liner, the formation may experience surge pressure as the fluid in the liner is forced to pass through the transition from the liner to the drill string and up the smaller diameter drill string. Thus, there is a need for a tool that will reduce surge pressure on the formation while a liner is lowered. A diverter tool which has ports that may be alternated between open and closed positions is also desirable to provide for circulation as the liner is lowered into the wellbore. Examples of such tools are shown in U.S. Pat. Nos. 6,082,459 and 6,182,766, which are incorporated herein by reference in their entirety. Although such tools work well, there is a continuing need for a diverter tool that can be alternated between open and closed positions, and that can be positively locked in the closed position prior to the time cementing operations begin.

SUMMARY

The diverter tool of the present invention comprises a housing, or diverter body that defines a longitudinal flow passage. At least one and preferably a plurality of diverter flow ports are defined through the diverter body and intersect the longitudinal flow passage. The diverter tool is adapted to be connected at its upper and lower ends into a pipe string which is utilized to lower a liner into a well that may be a partially cased well. The liner will be lowered with the pipe string into the well so that it may be cemented in an uncased portion of the well.

The diverter tool has a first closure member movable between first or open and second or closed positions. In the open position of the first closure member, the first closure member does not cover the flow ports and allows communication therethrough. In the closed position, the first closure member covers the flow ports. The diverter tool may also include a second closure member. The second closure member has an open position in which it does not cover the flow ports and a second or closed position in which the second closure member covers the flow ports to prevent communication therethrough.

The first closure member may be a first or outer sleeve that is disposed about and is reciprocable on the diverter body between its open and closed positions. The second closure member may be a second or inner sleeve that is detachably connected in the diverter body in its open position.

A setting tool may be displaced into the diverter tool to engage the second closure member. The setting tool may comprise a generally cylindrical sleeve with a rupturable member that prevents flow through the setting tool until a burst or rupture pressure of the rupturable member is reached. The rupture or burst pressure of the rupturable member is of a magnitude sufficient to allow the setting tool to detach the second closure member from its open position and move the second closure member to its closed position prior to rupturing.

When both of the first and second closure members are in their open positions, the diverter tool is in its run-in or open position as it is being lowered into a well. If it is desired to circulate through the diverter tool as the liner is being lowered into the well, the first closure member may be moved to its closed position which is the circulation position of the diverter tool. The first closure member may be connected to a drag spring which will engage the casing through which it is being lowered. Thus, when upward pull is applied to the pipe string, the first closure member will move relative to the diverter body. The first closure member may be reciprocated on the diverter body between its open and closed positions.

When the liner has reached a desired location in the well, the setting tool may be utilized to move the second closure member from its open to its closed position which is also the closed position of the diverter tool. Pressure can be increased in the pipe string to the burst pressure of the rupturable member which will establish full bore flow through the setting tool. The liner can then be cemented in the uncased portion of the well.

DETAILED DESCRIPTION

Figure 1A:
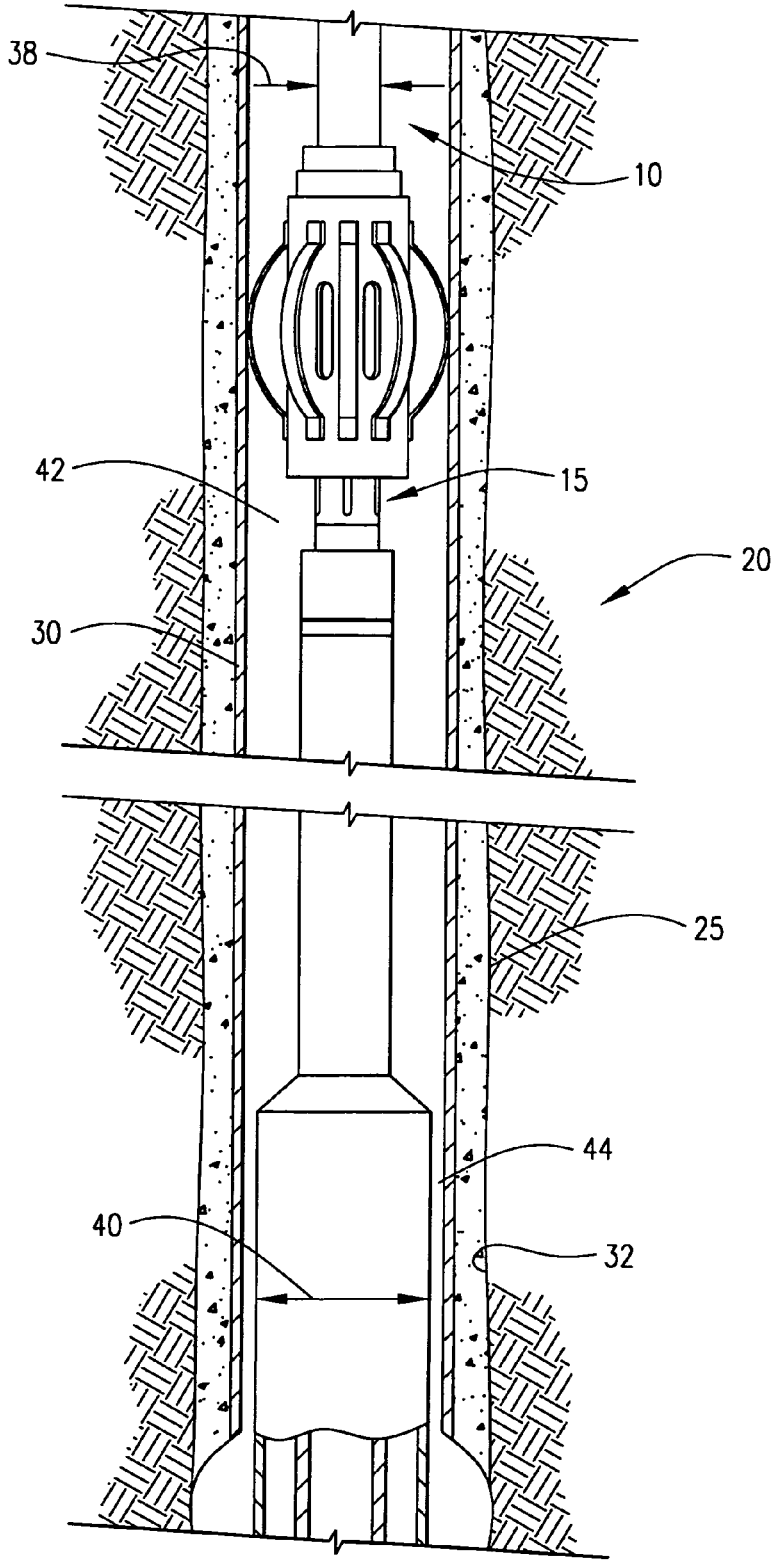
FIGS. 1A and 1B schematically show a diverter tool connected in a pipe string and a liner being lowered through a casing in a well.

Referring now to the drawings and more specifically to FIG. 1, a pipe string 10, which may be a drill string, including a drill string diverter, or diverter tool 15 of the present invention is disposed in a well 20. Well 20 is a partially cased well and thus comprises wellbore 25 with casing 30 cemented therein. Well 20 has cased portion 32 and uncased portion 34.

Pipe string 10 with drill string diverter 15 connected therein is connected to and is used to lower a liner 36 into well 20. As is known in the art, liner 36 will be lowered through casing 30 and will typically be hung in well 20 with a liner hanger and then cemented in uncased portion 34. Pipe string 10 has an outer diameter 38 that is smaller than outer diameter 40 of liner 36. An upper annulus 42 is defined by and between casing 30 and pipe string 10 and a lower annulus 44 is defined by and extends between liner 36 and casing 30 as the liner is lowered into the well.

Liner 36 may have, for example, a plug set 46 disposed therein of a type known in the art. Liner 36 may also have a fill apparatus 48 which may be for example like that shown in U.S. Pat. No. 5,641,021. Liner 36 may also include float apparatus such as for example float collar 50 and float shoe 52.

Figure 3:
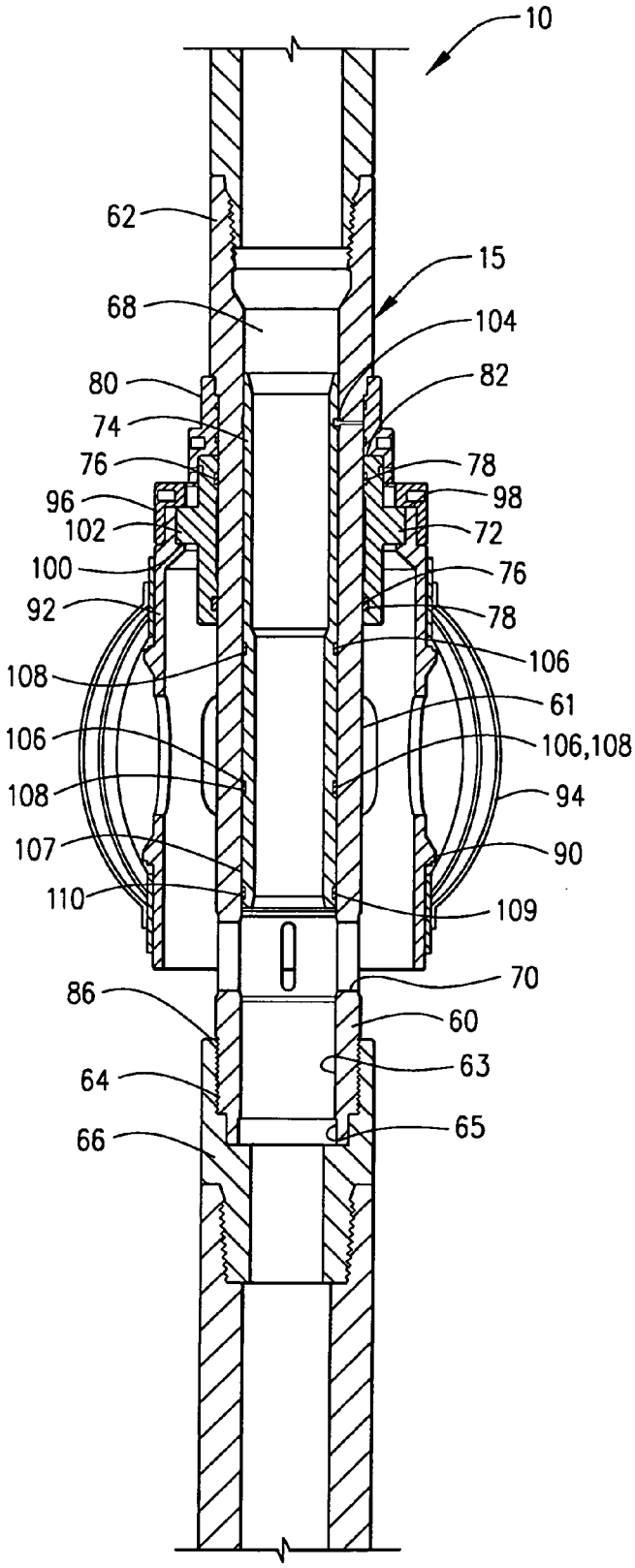
FIG. 3 is a cross-sectional view of the diverter tool in the run-in position.
Figure 4:
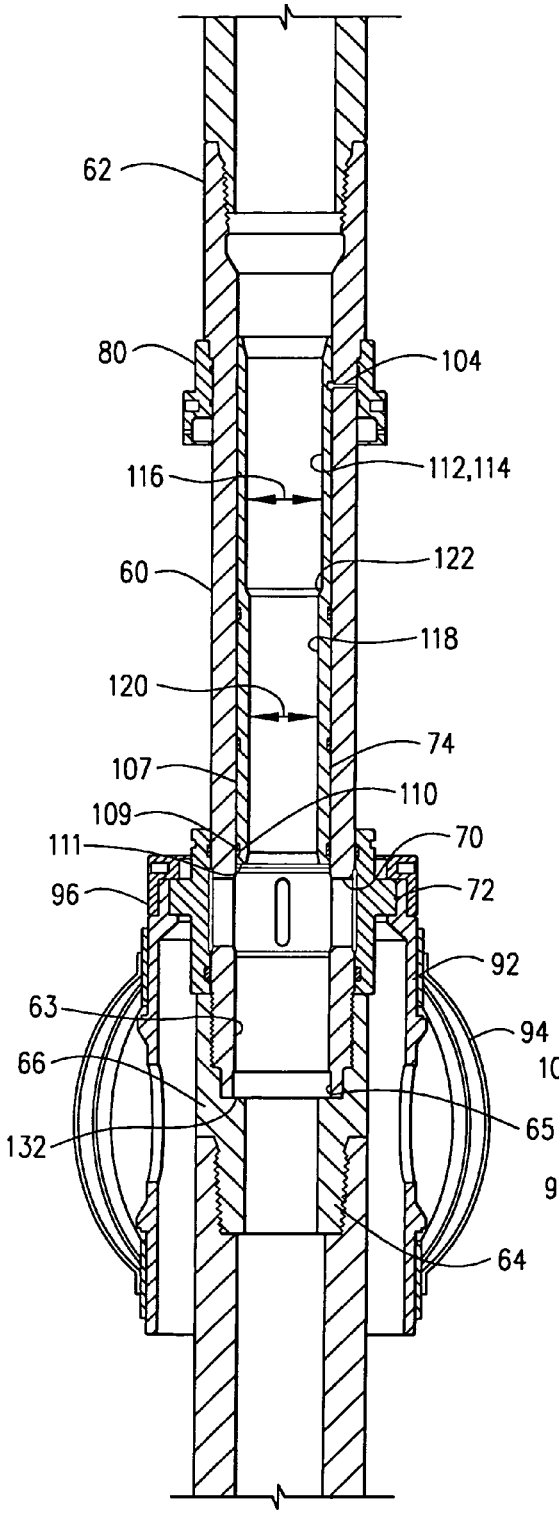
FIG. 4 is a cross section of the diverter tool in the circulation position.
Figure 5:
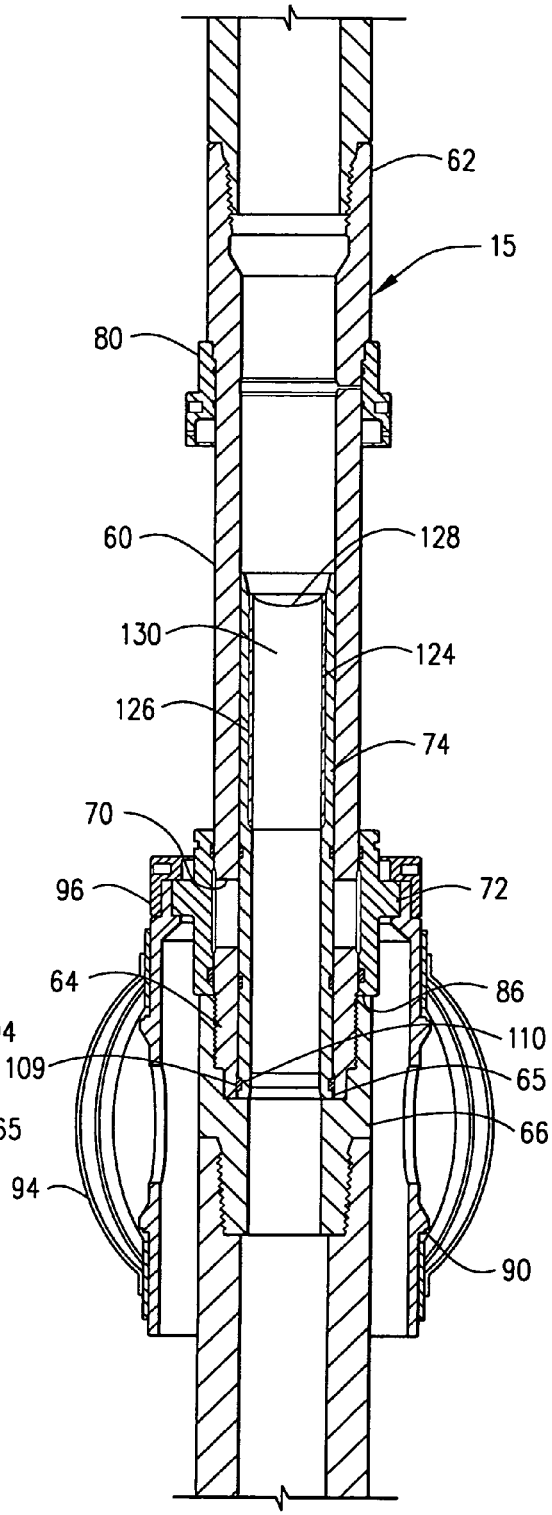
FIG. 5 is a view of the diverter tool in a closed position.

Referring now to FIGS. 3-5, diverter tool 15 is shown in cross section in a run-in position in FIG. 3, a circulation position in FIG. 4 and a closed position in FIG. 5. Diverter tool 15 comprises a housing, or diverter body 60 having outer surface 61 and upper and lower ends 62 and 64, respectively, which are adapted to be connected in pipe string 10. An inner surface 63 or diverter body 60 has a groove 65 therein at lower end 64. An adapter 66 may be utilized at lower end 64 to connect diverter tool 15 in pipe string 10. Diverter body 60 defines longitudinal flow passage 68 and has a plurality of diverter flow ports 70 defined therethrough which, in the run-in position shown in FIG. 3, will communicate longitudinal flow passage 68 with upper annulus 42.

Diverter tool 15 further includes a first or outer closure member 72 and a second or inner closure member 74. First closure member 72 comprises a sleeve and thus first closure member 72 may be referred to as first or outer sleeve 72. Outer sleeve 72 is slidably disposed about outer surface 61 of diverter body 60. Outer sleeve 72 may have grooves 76 with O-rings 78 therein so that sleeve 72 is slidingly and sealingly disposed about diverter body 60. Outer sleeve 72 is movable on diverter body 60 from its first, or open position shown in FIG. 3 wherein sleeve 72 does not prevent communication between annulus 42 and longitudinal flow passage 68 and its closed position shown in FIG. 4, in which outer sleeve 72 blocks communication between longitudinal flow passage 68 and annulus 42. An upper stop 80 is connected to housing 60. Upper stop 80 has a downward facing shoulder 82 which will provide an uppermost point of travel for outer sleeve 72.

Adapter 66 has an upward facing shoulder which comprises a lower stop 86 and provides a lowermost point of travel of outer sleeve 72. Outer sleeve 72 may be attached to a drag spring assembly 90, which may be of a type known in the art and may include a drag spring sleeve 92 with drag springs 94 mounted thereon. A sleeve retainer 96 may be threaded or otherwise connected to an upper end 98 of drag spring sleeve 92 and in conjunction with upward facing shoulder 100 on drag spring sleeve 92 defines a retaining groove for retaining outer sleeve 72 and more specifically for retaining a lug 102 defined on outer sleeve 72 so that outer sleeve 72 will move with drag spring assembly 90.

Second closure member 74 may comprise, and thus may be referred to as a second, or inner sleeve 74. Inner sleeve 74 is shown in a first or open position in FIGS. 3 and 4 in which it does not cover diverter flow ports 70. In its open position, inner sleeve 74 does not prevent communication between longitudinal flow passage 68 and upper annulus 42. Inner sleeve 74 is preferably detachably connected in its open position to diverter body 60 with a shear pin 104 or other means known in the art.

Inner sleeve 74 may have grooves 106 defined in an outer surface 107 thereof in which O-rings 108 are received. A lock ring 109 is received in a groove 110 defined in outer surface 107 at, or near, a lower end 111 of inner sleeve 74. Inner sleeve 74 has a stepped inner surface 112 which comprises first inner surface 114 defining an inner diameter 116 and second inner surface 118 defining a second inner diameter 120. First and second inner surfaces 114 and 118 define a seat 122 therebetween.

When it is desired to move inner sleeve 74 from its first or open position to its second or closed position, which is also the closed position of diverter tool 15 shown in FIG. 5, a setting tool, or setting sleeve 124 is displaced through pipe string 10. Setting tool 124 will engage seat 122. Setting tool, or setting sleeve 124 comprises a generally cylindrical sleeve, or member 126 with a rupturable member 128. Rupturable member 128 may be, for example, a rupture disk 128 which will span and cover the flow passage 130 defined by cylindrical member 126. The rupture or burst pressure of rupturable member 128 exceeds the pressure required to shear pins 104. Pressure applied in pipe string 10 will therefore cause shear pins 104 to shear so that setting tool 124 will move inner sleeve 74 until it engages an upwardly facing shoulder 132 defined on adapter 66 which acts as a stop to prevent any further downward movement of inner sleeve 74. In the position shown in FIG. 5, inner sleeve 74 covers diverter flow ports 70. Inner sleeve 74 is positively locked in its closed position with lock ring 109 which snaps into groove 65, and holds inner sleeve 74 in place.

The operation of the invention is clear from the drawings. Liner 36 is lowered into well 20 with pipe string 10 which includes diverter tool 15. As liner 36 is lowered, drag springs 94 will engage casing 30 so that as diverter tool 15 is lowered, it will be pushed upwardly to the open position or the run-in position of diverter tool 15 as shown in FIG. 3. Wellbore fluid may enter liner 36, for example, through fill apparatus 48 as liner 36 is lowered into well 20. If it is desired to circulate through pipe string 10 and liner 36, an upward pull may be applied to pipe string 10 and the engagement between drag springs 94 and casing 30 will hold drag spring sleeve 92 and outer sleeve 72 in place, so that outer sleeve 72 will move relative to diverter body 60 until it reaches its closed position as shown in FIG. 4, which is the circulation position of diverter tool 15. In the position shown in FIG. 4, outer sleeve 72 blocks flow through diverter ports 70 and prevents communication between longitudinal flow passage 68 and upper annulus 42. This process can be repeated as many times as desired as liner 36 is being lowered into well 20. Thus, outer sleeve 72 is reciprocable on housing 60 and may be moved between its open and closed positions which moves diverter tool 15 between its running and circulation positions as many times as desired. In the circulation position, fluid may be circulated through pipe string 10, including diverter tool 15, downwardly into and through liner 36.

Fluid that enters liner 36 through fill apparatus 48 will pass upwardly therein, and in the run-in position of diverter tool 15 will be communicated into longitudinal flow passage 68 and outwardly into upper annulus 42, to alleviate surge pressure.

Figure 1B:
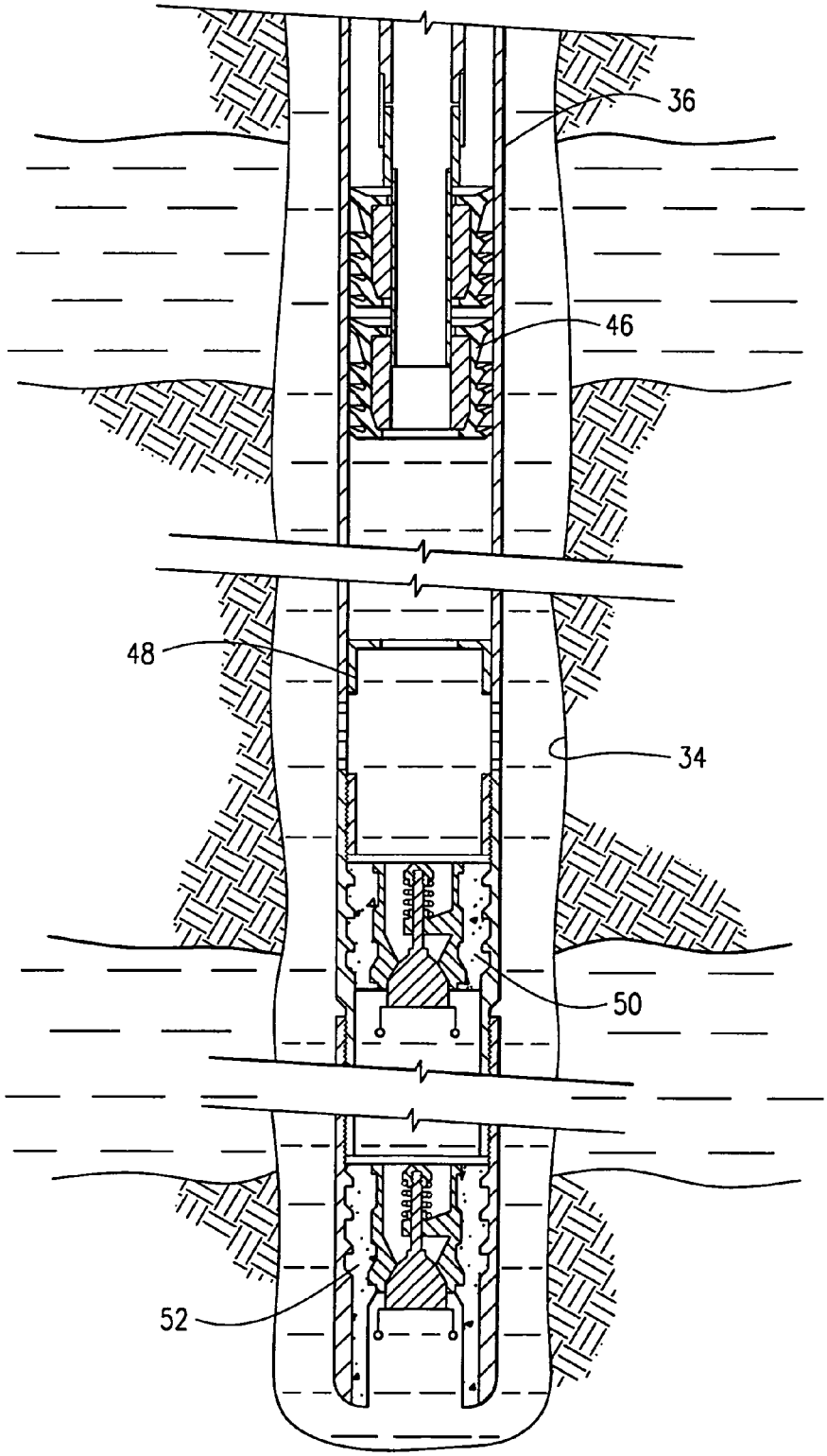
Figure 2A:
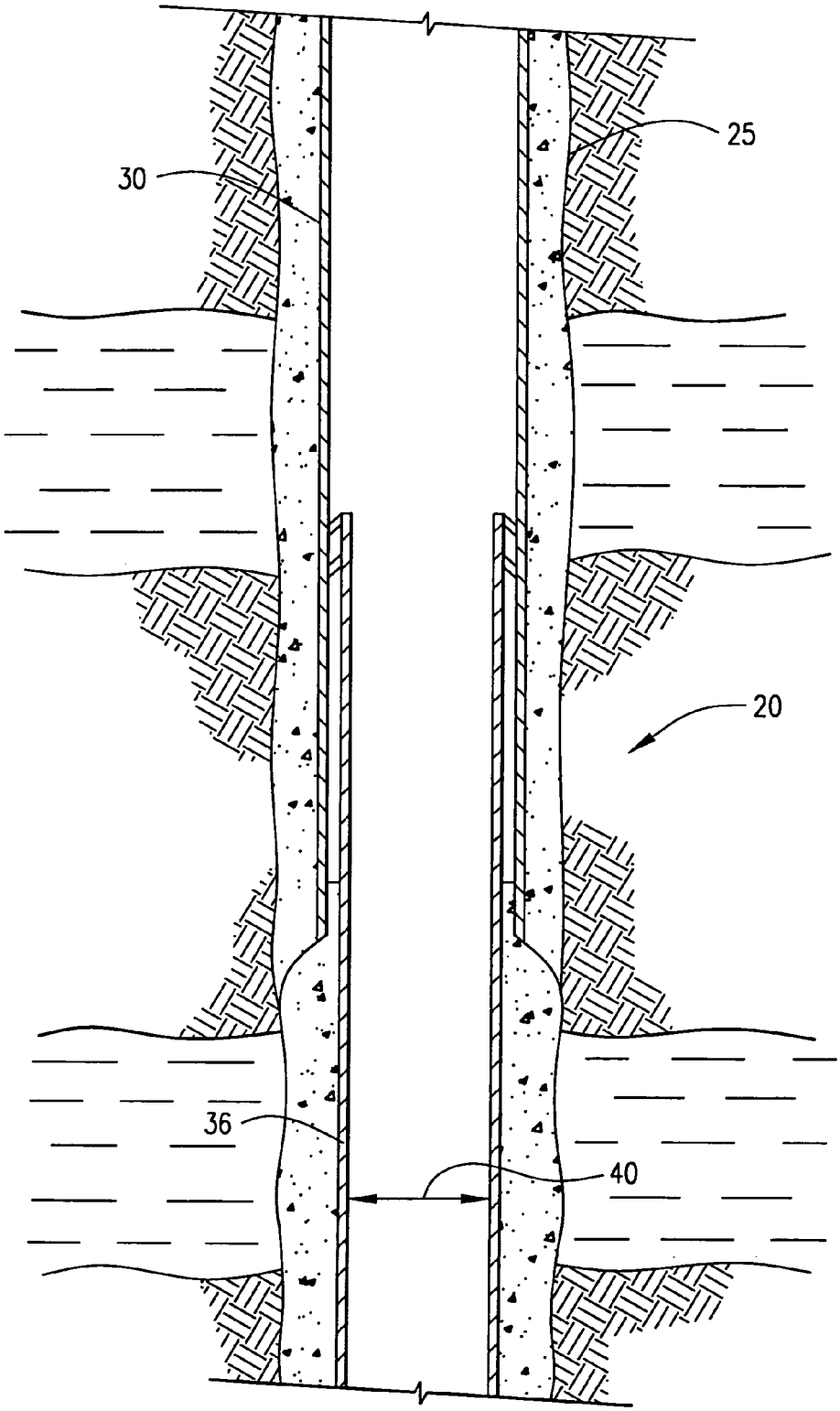
FIGS. 2A and 2B schematically show the liner after it has been cemented in a well.
Figure 2B:
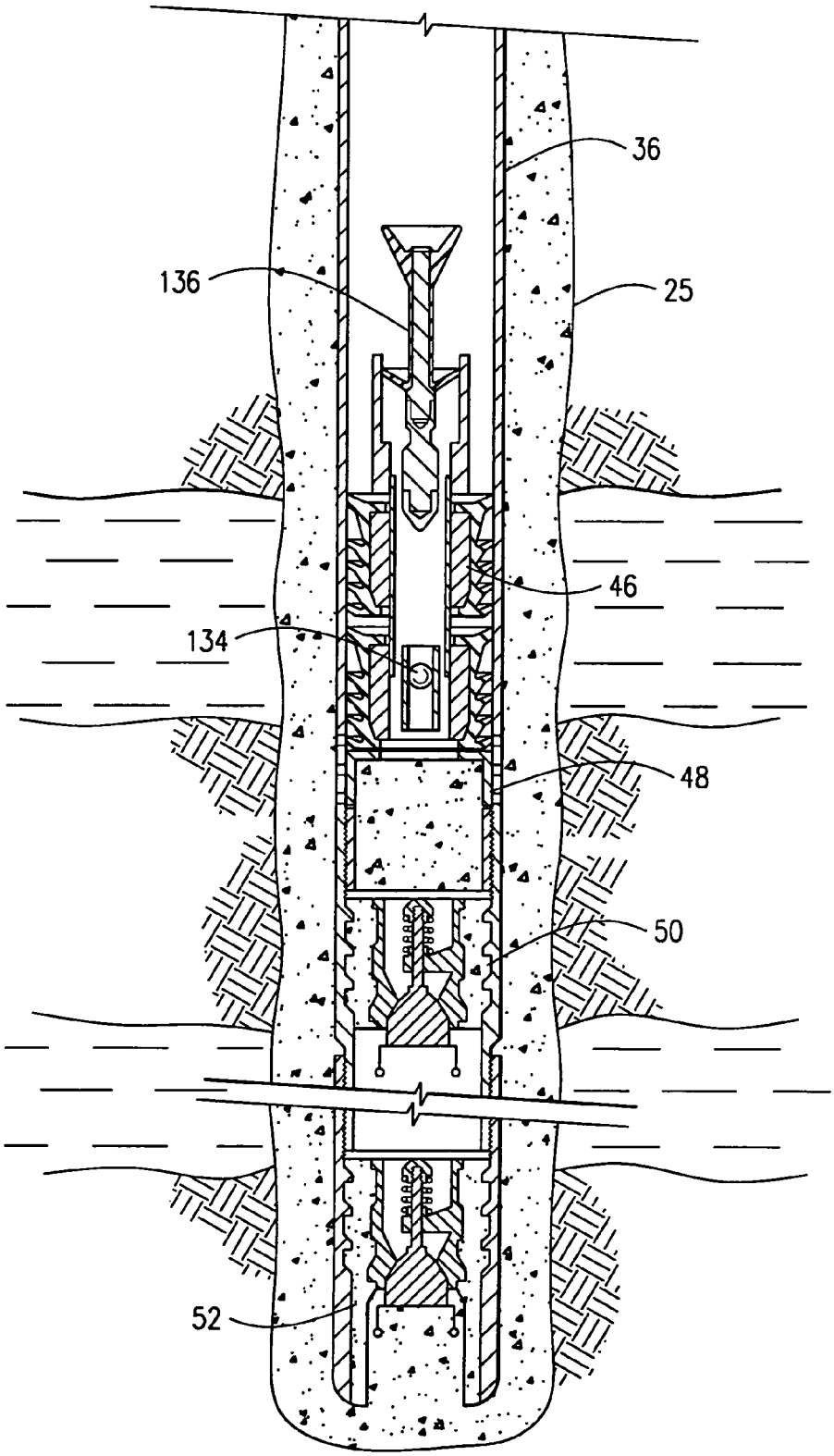

Once liner 36 has been lowered to a desired cementing location in the well, setting tool 124 is displaced through pipe string 10 until it engages seat 122. Pressure is increased causing inner sleeve 74 to be detached from diverter body 60 so that inner sleeve 74 is displaced to the position shown in FIG. 5 in which it covers diverter flow ports 70. Pressure can then be increased until the burst or rupture pressure of the rupturable member 128 is reached which will establish full bore flow through setting sleeve 124. Liner 36 can then be cemented in uncased portion 34. In a case where a plug set, such as for example plug set 46 schematically shown in FIGS. 1B and 2B is used, setting balls and/or setting darts like those shown in FIG. 2 and designated by the numerals 134 and 136, respectively, may be used to engage and move the plugs that make up plug set 46 downwardly in liner 36. The lower plug of a plug set 46 may be displaced in front of the cement to wipe an inner surface of liner 36. Once the cementing process is completed, a dart, such as setting dart 136 can be displaced to engage and move the upper plug of plug set 46. Thus, diverter tool 15 not only provides for circulation at any point during the time liner 36 is being lowered into well 20, it also provides positively lockable closure member 74 and provides for full bore flow so that closing balls, closing darts or other closure devices can pass therethrough if plug sets or other devices which require plugs or balls are utilized.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A diverter tool for use in a pipe string used to lower a liner in a well, the diverter tool comprising:

a diverter body defining a longitudinal flow passage, wherein the diverter body has flow ports therethrough to communicate the longitudinal flow passage with an annulus defined by the well and the diverter tool;

a first sleeve disposed about the diverter body and movable relative thereto, wherein the first sleeve has a first position and a second position; and a second sleeve disposed in the diverter body, wherein the second sleeve has a first position and a second position;

a setting tool receivable in the diverter body, wherein the setting tool can engage the second sleeve and move the second sleeve from its first to its second position, and wherein the setting tool comprises a generally cylindrical member receivable in the diverter body and a rupturable member for blocking flow through the generally cylindrical member; and wherein the longitudinal flow passage and the annulus are in communication through the flow ports when both of the first and second sleeves are in their first positions, and flow through the flow ports is blocked when either or both of the first and second sleeves are in their second positions.

2. The diverter tool of claim 1 wherein the first sleeve is movable between its first and second positions by reciprocating the diverter body in the well.

3. The diverter tool of claim 1 wherein the second sleeve is detachably connected to the diverter body in its first position.

4. The diverter tool of claim 1 wherein a burst pressure of the rupturable member is greater than a pressure required to move the second sleeve from its first position to its second position.

5. The diverter tool of claim 4 wherein the setting tool provides a flail bore flow passage after the second sleeve is moved from the first position to the second position and the rupturable member is ruptured.

6. A diverter tool for connection in a pipe string used to lower a liner in a well having a casing in a portion thereof, wherein the pipe string and the casing define an annulus therebetween, comprising:

a diverter body defining a longitudinal flow passage, wherein the diverter body has flow ports therethrough for communicating the longitudinal flow passage with the annulus;

a first closure member movable relative to the diverter body between an open position and a closed position; and a second closure member detachably connected to the diverter body in the open position and movable relative to the diverter body from its open position to a closed position, a setting tool for engaging the second closure member and moving the second closure member from its open position to its closed position, the setting tool comprising a cylindrical member defining a central passage, and a rupturable member blocking the central passage of the cylindrical member; and wherein communication through the flow ports is blocked when either, or both of the first and second closure members is in its closed position, and the longitudinal flow passage is communicated with the annulus when the first and second closure members are in their open positions.

7. The diverter tool of claim 6, wherein the first closure member is reciprocably movable on the diverter body while disposed in the well between the open and closed positions thereof.

8. The diverter tool of claim 6 wherein at least one of the first and second closure members is positively lockable in its closed position.

9. The diverter tool of claim 6 wherein the first closure member comprises an outer sleeve slidably disposed about the diverter body.

10. The diverter tool of claim 9 wherein the second closure member comprises an inner sleeve disposed in the diverter body.

11. A diverter tool used in lowering a liner in a partially cased wellbore, comprising:

a diverter body defining a longitudinal flow passage, wherein the diverter body has flow ports therethrough to communicate the longitudinal flow passage with an annular space around the diverter body;

a first sleeve disposed about and reciprocable on the diverter body from an open position wherein the first sleeve does not cover the flow ports, to a closed position wherein the first sleeve covers the flow ports and prevents communication therethrough;

a second sleeve detachably connected in the diverter body in an open position wherein the second sleeve does not prevent communication through said flow ports, wherein the second sleeve is detachable from the diverter body and movable to a closed position wherein the second sleeve blocks the flow ports and prevents communication therethrough; and a setting tool for moving the second sleeve from its open to its closed position, the setting tool comprising:

a cylindrical member defining a central passage; and a rupturable member covering the central passage.

12. The diverter tool of claim 11 wherein the diverter tool allows fill bore flow through the cylindrical member of the setting tool after the rupturable member is ruptured.

13. The diverter tool of claim 11 wherein the setting tool engages the second sleeve to move the second sleeve, and after the second sleeve is in the closed position the rupturable member is ruptured to allow flow through the setting tool.

14. The diverter tool of claim 11 wherein the second sleeve is positively lockable in the closed position.

15. A diverter tool for use in a pipe string used to lower a liner in a well, the diverter tool comprising:

a diverter body defining a longitudinal flow passage, wherein the diverter body has flow ports therethrough to communicate the longitudinal flow passage with an annulus defined by the well and the diverter tool;

a first sleeve disposed about the diverter body and movable relative thereto, wherein the first sleeve has a first position and a second position; and a second sleeve disposed in the diverter body, the second sleeve having a first position and a second position, wherein the second sleeve has an upper edge and a seat internally defined therein, the seat being axially positioned below the upper edge of the second sleeve;

a setting tool for engaging the seat and for moving the second sleeve from its first to its second position, the setting tool comprising a generally cylindrical member and a rupturable member for blocking flow through the generally cylindrical member, wherein the setting tool is receivable in the second sleeve; and wherein the longitudinal flow passage and the annulus are in communication through the flow ports when both of the first and second sleeves are in their first positions, and flow through the flow ports is blocked when either or both of the first and second sleeves are in their second positions.

16. The diverter tool of claim 15 wherein the first sleeve is movable between its first and second positions by reciprocating the diverter body in the well.

17. The diverter tool of claim 15 wherein the second sleeve is detachably connected to the diverter body in its first position.

18. The diverter tool of claim 15 wherein a burst pressure of the rupturable member is greater than a pressure required to move the second sleeve from its first position to its second position.

19. The diverter tool of claim 18 wherein the setting tool provides a full bore flow passage after the second sleeve is moved from the first position to the second position and the rupturable member is ruptured.

* * * * *